United States Patent [19]

Dziura et al.

[11] 4,144,738

[45] Mar. 20, 1979

[54] FASTENER SETTING HAND TOOL

[75] Inventors: Walter H. Dziura, Naugatuck; Robert B. Kendall, Southington, both of Conn.

[73] Assignee: Scovill Manufacturing Company, Waterbury, Conn.

[21] Appl. No.: 840,652

[22] Filed: Oct. 11, 1977

[51] Int. Cl.[2] ..... B21D 7/06

[52] U.S. Cl. ..... 72/410; 72/445; 81/363

[58] Field of Search ..... 72/409, 410, 412, 445, 72/451; 81/355, 362, 363

[56] References Cited

U.S. PATENT DOCUMENTS

| | | | |
|---|---|---|---|
| 562,368 | 6/1896 | Barry | 72/445 |
| 2,875,655 | 3/1959 | Lako | 81/363 |
| 3,250,450 | 5/1966 | LePage | 227/144 |
| 3,564,956 | 2/1971 | Landen | 81/363 |

FOREIGN PATENT DOCUMENTS

| | | | |
|---|---|---|---|
| 197136 | 5/1923 | United Kingdom | 81/363 |

*Primary Examiner*—C.W. Lanham
*Assistant Examiner*—Gene P. Crosby
*Attorney, Agent, or Firm*—Dallett Hoopes

[57] ABSTRACT

Toggle action hand-setting tool includes special cam surface on toggle parts to intensify setting pressure during the end of closing travel when greatest mechanical advantage is needed. Readily accessible spring means and special mounting means for fastener-part holders are features. Frame may be designed to yield slightly to avoid breakage which might otherwise result if device is used with oversize fabric.

7 Claims, 14 Drawing Figures

FASTENER SETTING HAND TOOL

BACKGROUND OF THE INVENTION

1. Field of the Invention

This invention relates to a fastener-setting hand tool. More specifically, the invention relates to a hand tool which, by a modest amount of hand pressure, can exert a large force to set a fastener, such as a snap fastener part, onto fabric. The invention includes novel means for exerting such force and special means for holding snap fastener parts.

2. Description of the Prior Art

In the prior art, there are several versions of fastener-setting tools adapted to be hand-operated. An example is the U.S. Pat. No. 3,250,450 to LePage et al. This patent discloses a device of the plier type in which the jaws have fastener-part holding means. While the structure shown in this patent is meritorious, there are practical limitations as to the amount of force which may be exerted using such a device. This becomes a special concern when the fastener parts are larger in size, requiring more pressure.

Another fastener-setting device is disclosed in the U.S. Pat. No. 2,875,655 to Lako. In this patent is disclosed a die and a punch which are driven together by a toggle device moved by a lever comprising an extension of one of the toggle elements. The structure of such prior devices, while capable of producing more setting force than shown in LePage, is of limited versatility.

SUMMARY OF THE INVENTION

Under the present invention, great force is able to be applied by a hand-setting tool by virtue of a combination of several features. As one feature, the jaw itself of the device is movable as contrasted to the movable punch of prior patents with the toggle action. Additionally, the toggle parts of the present structure are especially designed to exert a maximum closing force at the end of the jaw stroke. Novel means are provided to hold the fastener parts.

A special feature of the structures embodying the invention is that the spring biasing the setting tool in the open position is readily accessible for repair or replacement should it be necessary.

BRIEF DESCRIPTION OF THE DRAWINGS

Other features of the invention will be clear from a reading of the following description with reference to the drawings, all disclosing a non-limiting embodiment of the invention.

In the drawings.

DESCRIPTION OF THE PREFERRED EMBODIMENT

Figures 1, 2, 3, 4, 5, 6:
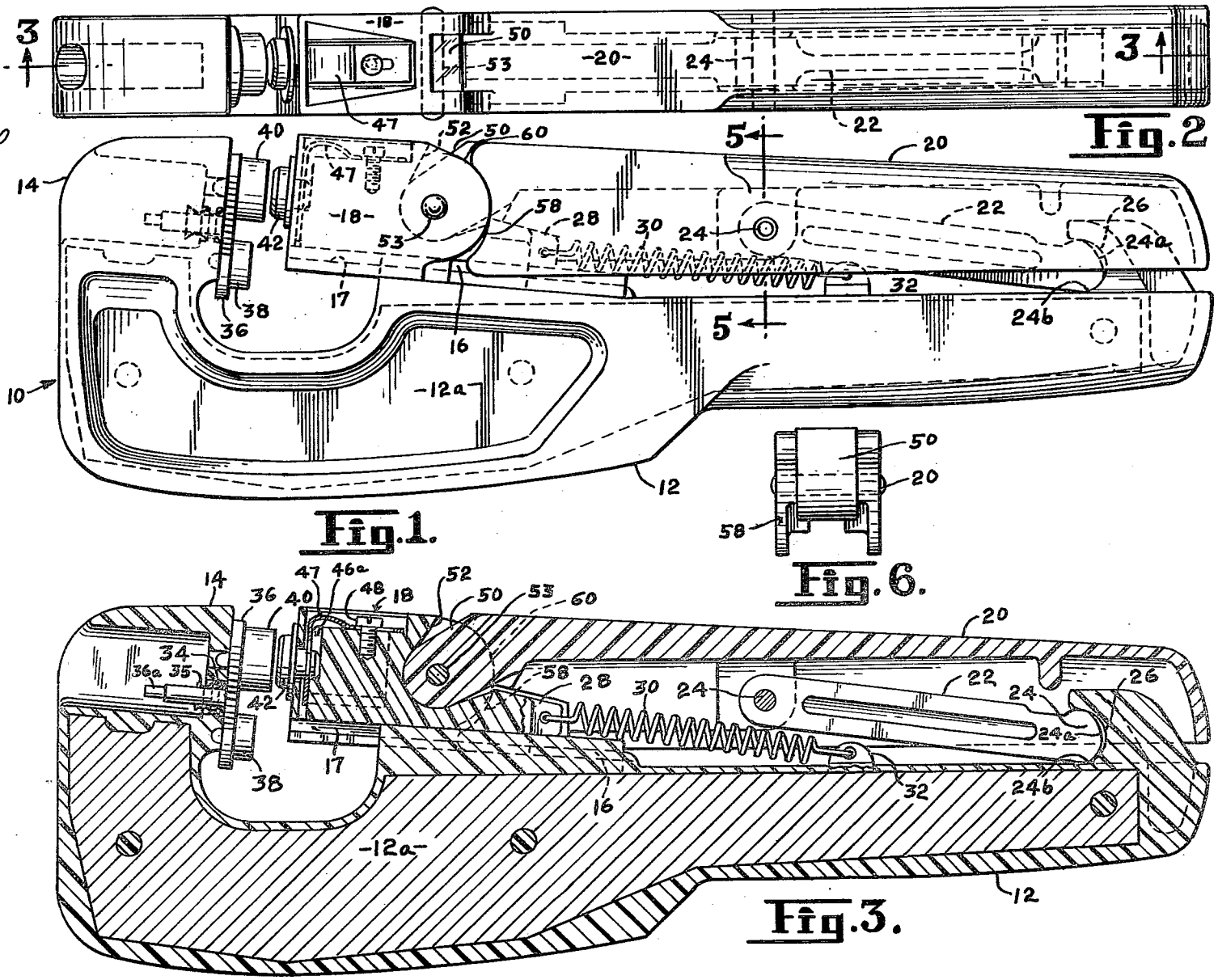
FIG. 1 is a side view of a tool embodying the invention and showing various inner parts in phantom.
FIG. 2 is a top view.
FIG. 3 is a sectional view taken on the line 3—3 of FIG. 2.
FIG. 4 is a rear view.
FIG. 5 is a sectional view taken on the line 5—5 of FIG. 1.
FIG. 6 is a view of the left end of the lever as shown in FIG. 1.

Referring more specifically to the drawings, an embodiment of the hand tool of the invention is generally designated 10 in FIG. 1. It comprises an elongated handle 12 having a first jaw 14 at one end. Spaced from the jaw but on the same side of the handle, the handle is formed with a "T" track 16 which operatively receives "T"-shaped cutout 17 of the second sliding or movable jaw 18. A lever 20 comprises the second handle and engages the sliding jaw 18 at one end. A link 22 is pivotally attached by a pin 24 to the second handle 20 intermediate the ends of the handle, and the distal end of the link 22 is formed with a head 24 which engages in a socket 26.

Figures 7, 8, 8A, 9, 10, 11, 12, 13:
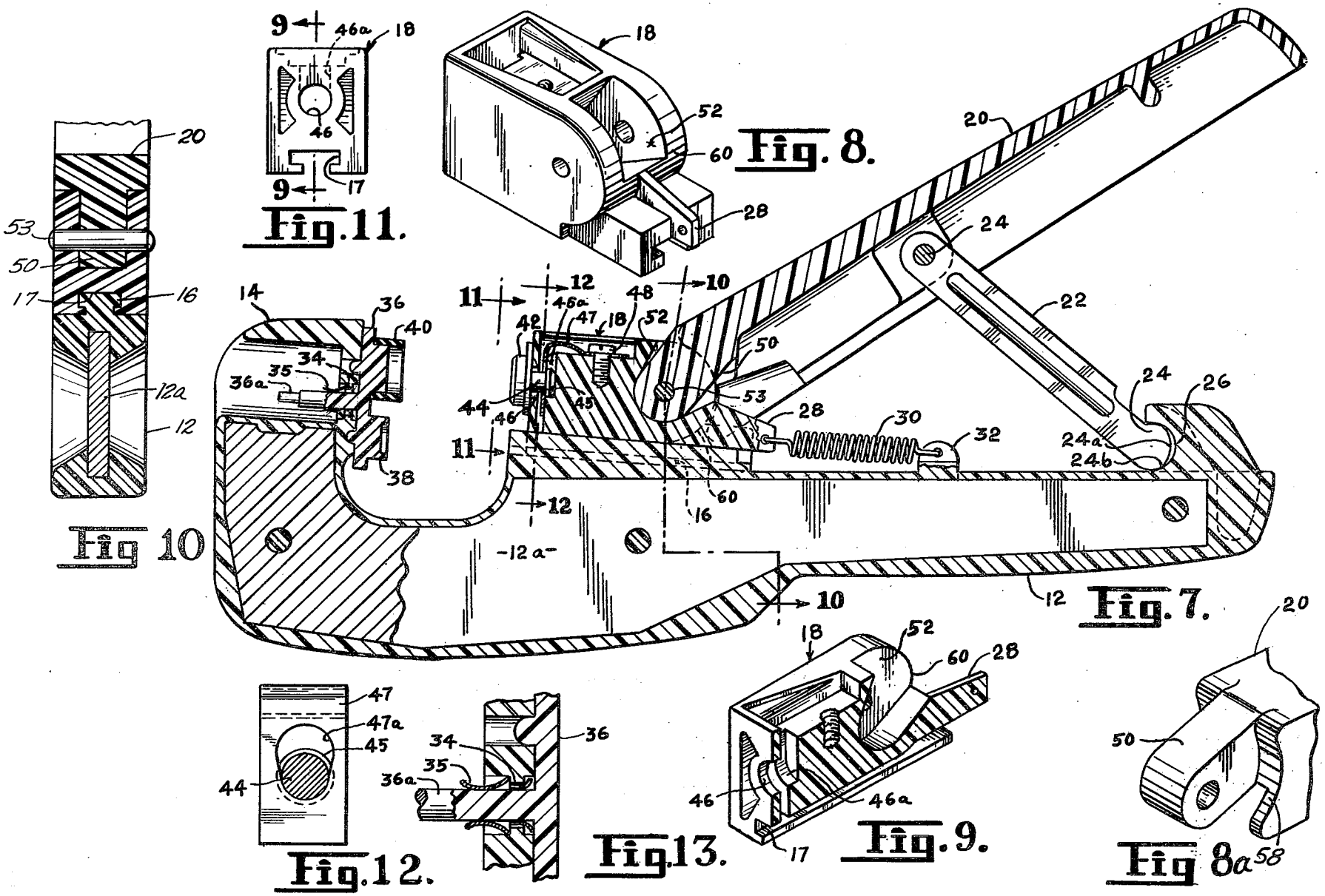
FIG. 7 is a sectional view comparable to FIG. 3 but showing the tool in the open position and with part of the metal frame in profile.
FIG. 8 is a perspective view showing the movable jaw.
FIG. 8*a* is a fragmentary perspective view of the left end of the lever as shown in FIG. 7.
FIG. 9 is a sectional perspective view of the movable jaw with section taken on the line 9—9 of FIG. 11.
FIG. 10 is a sectional view taken on the line 10—10 of FIG. 7.
FIG. 11 is a left end view taken of the movable jaw as in FIG. 7 with the fastener-part holding means removed.
FIG. 12 is a sectional view taken on the line 12—12 of FIG. 7.
FIG. 13 is an enlarged fragmentary view of the turntable pivot.

The sliding jaw 18 is formed with a tail 28 to which is attached a spring 30, the other end of the spring being attached to the handle 12 at eye 32. The spring 30, urging a rightward force on the jaw 18, biases the device with the jaws in open position as shown in FIG. 7. The jaws are brought together when the operator squeezes the two handles together so that the force of the toggle structure shown moves the second jaw 18 towards the first jaw 14.

Still more specifically, the handle 12 is preferably formed of fiberglass-reinforced plastic which may derive great strength from having embedded centrally therein a reinforcing plate 12*a* of steel which avoids distortion of the structure, if desired.

As shown, the jaw 14 is formed with an opening 34 which carries a sheetmetal bearing 35 (FIG. 13) clipped in a narrow throat of the opening 34. The bearing journals the stem 36*a* of a turntable 36 comparable to the turntable shown in the above-mentioned LePage patent. The projections 38 and 40 on the turntable are adapted to respectively hold a selected part of a snap fastener, for instance, and the part is made during use of the device to take the position on the jaw 14 which is aligned with the fastener-holding part on the jaw 18.

A fastener-holding projection 42 is carried by jaw 18. The projection 42 is formed with a stem 44 (FIG. 7) which terminates in a head 45 and passes through an ample opening 46 in the jaw and into recess 46*a*. An L-shaped sheetmetal spring leaf 47 is secured to the jaw by screw 48 and has a keyhole-shaped opening 47*a* (FIG. 12) biased with its smaller portion aligned with opening 46 to hold the stem 44 captive.

The lever or second handle 20, as best shown in FIG. 6, is formed with a relatively thin head 50 which fits into a slot 52 in the lower end of the jaw. As shown (FIGS. 1, 8), a pin 53 pivots the part 20 to jaw 18. Shoulders 58 are formed adjacent the head 50 and present bearing surfaces (FIG. 8*a*) against the arcuate end 60 of the jaw and may absorb some of the force on the pivot pin 53.

A special nuance of the invention involves the shaping of the head 24. It should be noted that the head 24 of the link 22 has a flattened zone in 24*a* and comes to a relatively rounded point 24*b* at its surface most remote from the pin 24. From this configuration, when the second handle 20 is squeezed against the handle 12, at the end of the travel great mechanical advantage is used as the pointed end 24*b* of the head 24 comes in bearing contact with the round wall socket 26. This camming action serves to exert great force and additional movement to the jaw 18 as it moves toward the jaw 14.

The structure described permits with great ease the setting of larger sizes of snap fastener elements and other fasteners. Overall, the structure is designed to generate and utilize without distortion, great forces with relatively modest hand squeezing action.

While the invention has been disclosed in only one embodiment, it is susceptible of many modifications, all falling within the scope of the following claim language or equivalents thereof.

We claim:

1. A fastener applier comprising an elongate handle having a fixed jaw disposed rigidly at one end thereof, a movable jaw opposing the fixed jaw, the movable jaw being operatively mounted on a track on the handle and movable toward and away from the fixed jaw, the jaws each having holding means on its working face for holding, respectively, the parts of a fastener, lever means having at one end a head pivotally secured to the movable jaw and comprising an operating lever for the applier, a link pivotally attached to the lever intermediate its ends, the distal end of the link being pivotally associated with the handle at the end of the handle opposite the fixed jaw, spring means operatively connected between the movable jaw and a point on the handle spaced toward the said opposite end from the movable jaw, whereby movement of the lever means toward the handle moves the jaws together against the bias of the spring to set the fastener parts disposed in the respective jaws.

2. A fastener applier as claimed in claim 1 wherein the handle is of plastic, having a flat metal strengthening plate centrally embedded therein.

3. A fastener applier as claimed in claim 1 wherein the means for holding the fastener part on the fixed jaw comprises a turntable having a pair of holding elements selectively alignable with the holding means on the movable jaw as the turntable is turned.

4. A fastener applier as claimed in claim 1 wherein an L-shaped spring secured by one leg to the jaw and having a keyhole-shaped slot in the other leg, the said other leg facing the fixed jaw, the movable jaw having an opening also facing the fixed jaw, the opening normally being in alignment with the smaller portion of the slot, the fastener holding means including a necked and headed element extending through the opening and slot and being engaged by the spring and thereby held in the movable jaw, but being releasable by finger pressure on the said one resilient leg to move the other leg so that the wide part of the slot aligns with the opening.

5. A fastener applier as claimed in claim 1 wherein the distal end of the link is an irregularly shaped head which fits in a socket in the handle at the pivot association so that as the lever is drawn to the handle, the movement to the jaws together in the final portion of the travel of the lever is enhanced as the head turns in its socket.

6. A fastener applier as claimed in claim 5 wherein the head is formed with a flattened side and also a high spot at the end thereof.

7. A fastener applier comprising an elongate handle having a fixed jaw disposed rigidly out from one end thereof, a movable jaw opposing the fixed jaw, a T-shaped track secured on the same side of the handle as the fixed jaw, the movable jaw having means slidedly receiving the T-shaped track and being movable along the track toward and away from the fixed jaw, the jaws each having holding means on its working face for holding, respectively, the parts of a fastener, a lever being pivotally secured at one end to the movable jaw and comprising an operating lever for the applier, and a link pivotally attached to the lever intermediate its ends, the other end of the link being pivotally associated with the handle near the end of the handle opposite the fixed jaw, whereby movement of the lever toward the handle moves the jaws together to set the fastener parts disposed in the respective jaws.

* * * * *

UNITED STATES PATENT AND TRADEMARK OFFICE

Certificate

Patent No. 4,144,738 Patented March 20, 1979

Walter H. Dziura and Robert B. Kendall

Application having been made by Walter H. Dziura and Robert B. Kendall, the inventors named in the patent above identified, for the issuance of a certificate under the provisions of Title 35, Section 256, of the United States Code adding the name of James B. Kruger as a joint inventor, and a showing and proof of facts satisfying the requirements of the said section having been submitted, it is this 6th day of May 1980, certified that the name of the said James B. Kruger is hereby added to the said patent as a joint inventor with the said Walter H. Dziura and Robert B. Kendall.

FRED W. SHERLING,
*Associate Solicitor.*